United States Patent [19]

Hasegawa et al.

[11] Patent Number: 4,954,395

[45] Date of Patent: Sep. 4, 1990

[54] RECORDING MEDIUM

[75] Inventors: Kenji Hasegawa, Isehara; Takahiro Mori, Ayase; Masahiko Higuma, Sagamihara, all of Japan

[73] Assignee: Canon Kabushiki Kaisha, Tokyo, Japan

[21] Appl. No.: 178,265

[22] Filed: Apr. 6, 1988

[30] Foreign Application Priority Data

Apr. 10, 1987 [JP] Japan ..... 62-87095
Mar. 31, 1988 [JP] Japan ..... 63-79263

[51] Int. Cl.[5] ..... B41M 5/00

[52] U.S. Cl. ..... 428/318.4; 346/135.1; 428/195; 428/207

[58] Field of Search ..... 346/1.1, 135.1; 428/195, 211, 537.5, 212, 34.4, 207, 318.4

[56] References Cited

U.S. PATENT DOCUMENTS 4,554,181 11/1985 Cousin et al. ..... 428/211
4,785,313 11/1988 Higuma et al. ..... 427/161

*Primary Examiner*—Pamela R. Schwartz
*Attorney, Agent, or Firm*—Fitzpatrick, Cella, Harper & Scinto

[57] ABSTRACT

A recording medium is provided which comprises an ink-transporting layer and ink-retaining layer. The ink-transporting layer contains in combination a surfactant and/or a penetrant and a material having the property of fixing a colorant contained in an ink.

34 Claims, No Drawings

RECORDING MEDIUM

BACKGROUND OF THE INVENTION

Field of the Invention

The present invention relates to a recording medium suitable for ink-jet systems, and, more particularly, to a recording medium whose printing surface and image-viewing surface are in an obverse and reverse relationship, and which can obtain recorded images superior in gloss and storage stability without effecting a post-treatment such as laminating.

Related Background Art

Hitherto used as recording mediums suited for ink-jet recording systems, particularly for full color recording, are ink-jet papers comprising a porous layer formed by coating pigments such as silica on a paper surface, and ink-jet OHP (overhead projector) films comprising a plastic film surface coated with resins absorptive of inks by dissolution or swelling.

The above described ink-jet paper, in which the absorption of inks is effected by its porous layer, absorb inks speedily and is therefore suited for making images multicolored and for high speed printing, advantageously. On the other hand, however, since images are viewed also from the same porous layer side as the printing surface, it is so constituted that recording agents are forced to remain as much as possible on the surface of an absorbing layer, thus having the disadvantage that it is inferior in the durability such as water resistance and abrasion resistance and the storage stability of images, and the disadvantages such that there can be obtained no glossy recorded images.

Glossy images can be obtained in the recording mediums of the type in which the inks are absorbed by dissolution or swelling of resins like the ink-jet OHP films, but inks are so slowly absorbed and fixed that there are also problems that staining or feathering due to the transfer of images, and also non-uniformity of image density called beading caused by irregular migration of inks tend to occur in the high speed printing or multicolor printing to make it difficult to obtain sharp and beautiful images.

On the other hand, Japanese Patent Laid-open Publications No. 136480/1983, No. 136481/1983, No. 197285/1986, etc. contain disclosures relating to ink-jet recording mediums of the type that a porous ink absorbing layer is provided on a transparent support, the recording is performed from the porous ink absorbing layer side according to the ink-jet system, and images are viewed from the transparent support side.

The recording mediums of this type are advantageous as the various performances such as water resistance and abrasion resistance have been sufficiently settled, and yet inks can be speedily absorbed, highly glossy images can be obtained, and beading can be prevented from occurring. However, when printing is performed on the recording mediums of this type according to the ink-jet system, there has been a disadvantage that even through the image-viewing surface is the transparent support side, actually the image density at the viewing surface side becomes lower than the image density at the printing surface side.

To settle this problem, the present inventors developed previously a recording medium such that the image density of the viewing surface may be raised higher that that of the printing surface by providing an ink-retaining layer between a porous ink-transporting layer and a transparent substrate. Further the porous ink-transporting layer absorbs inks by itself as little as possible and has through-holes (EP No. 227 254 A2).

However, also in the recording medium according to this prior invention, it is difficult to obtain the porous ink-transporting layer that allows all of the inks to penetrate into the ink-retaining layer and does not allow any ink to remain at all in the former, actually leading to the result that ink components always more or less remain in the porous ink-transporting layer. For this reason, when the records obtained by performing recording on the above recording medium according to the ink-jet system are stored for a long period of time or stored under the condition of high humidity, there has arisen the problem that a colorant in an ink migrates by diffusion over the surfaces of pores in the porous ink-transporting layer to cause feathering of images.

In order to prevent such feathering of images after storage, it is known to add to the porous layer a material having the property of fixing the colorant in the ink in the case of the above-mentioned conventional ink-jet coat paper or the like.

However, in the above recording medium of the prior invention made by the present inventors, the ink-applying surface and the image-viewing surface are in an obverse and reverse relationship, and a porous ink-transporting layer that may not allow the greater part of colorant to remain but has good liquid permeability is provided for the purpose of increasing the image density on the viewing surface. Accordingly, incorporation of the colorant-fixing material as mentioned above into this porous ink-transporting layer has been an idea that has not been hitherto considered since it decreases not only the liquid permeability of the ink-transporting layer but also the ink absorbing ability of the whole recording medium to lower the image density on the viewing surface.

SUMMARY OF THE INVENTION

An object of the present invention is to provide a recording medium having superior ink-absorbing ability, giving images having a high gloss and image density, and yet free from any feathering of images even when stored for a long period of time or under the condition of high humidity.

The above object can be achieved by the invention described below.

The present invention provides a recording medium comprising an ink-transporting layer and an ink-retaining layer, wherein said ink-transporting layer contains in combination at least one of a surfactant and a penetrant, and a material having the property of fixing a colorant contained in an ink.

In another embodiment of the present invention, there is provided a recording medium comprising an ink-transporting layer and an ink-retaining layer, wherein said ink-transporting layer contains in combination at least one of a surfactant and a penetrant, and a material having the property of fixing a colorant contained in an ink, and said ink-retaining layer contains a material having the property of fixing a colorant contained in an ink.

In still another embodiment or the present invention, there is provided a recording medium comprising an ink-transporting layer and an ink-retaining layer, wherein said ink-transporting layer is chiefly comprised of a particulate material, a binder and at least one of a surfactant and a penetrant, and said particulate material or said binder is a material having the property of fixing a colorant contained in an ink.

DETAILED DESCRIPTION OF THE PREFERRED EMBODIMENTS

The present inventors found that in the recording mediums of the type that an ink-transporting layer and an ink-retaining layer are provided, an ink is applied from the ink-transporting layer side, and images are viewed from the ink-retaining layer side, the above ink-transporting layer is basically a layer that may not be dyed by the colorant in an ink, and when an ink is applied, the greater part of the ink passes through the ink-transporting layer, reaches to the ink-retaining layer, and is absorbed and fixed there, but, actually, the colorant in the ink more or less remain in the ink-transporting layer, and this remaining colorant migrates with time in a dispersing state through the ink-transporting layer during storage for a long period of time or storage under the condition of high humidity to cause the occurrence of feathering in the images having been formed.

However, as is seen in the conventional ink-jet coat paper, it has not been hitherto practiced to incorporate the material having the property of fixing the colorants into the ink-transporting layer of the recording medium of the type like the prior invention made by the present inventors, because the liquid permeability of the ink-transporting layer is considered to be thereby decreased and also the image density on the viewing surface is lowered.

As a result of intensive studies, the inventors of the present application found that a recording medium having a high image density and yet free from any feathering of images with lapse of time even when stored for a long period of time or stored under the condition of high humidity can be obtained without causing the problems as stated above the without bringing about any difficulties in the ink absorbing ability, if a colorant-fixing material is contained in a certain specific proportion relative to a surfactant and/or a penetrant contained in the ink-transporting layer.

The present invention will be described below in greater detail by giving preferred embodiments of the present invention.

The recording medium used in the present invention is constituted of a substrate as a support, an ink-retaining layer formed on said substrate and on which inks or dyes are substantially absorbed and captured to form colors, and an ink-transporting layer formed on the ink-retaining layer and which has liquid-permeability to inks, transports the inks applied to the ink-retaining layer and does not substantially absorb the inks in itself.

Provided that the substrate is not necessarily required if the ink-transporting layer or ink-retaining layer also has the function as a substrate.

Any conventionally-known materials can be used as the substrate used in the above recording medium, specifically including plastic films or sheets made of a polyester resin, a diacetate resin, a triacetate resin, polystyrene resin, a polyethylene resin, a polycarbonate resin, a polymethacrylate resin, cellophane, celluloid, a polyvinyl chloride resin, a polyvinylidene chloride resin, a polysulfone resin, a polyimide resin or the like, or glass sheet, etc. There is no particular limitation in the thickness of these substrates, but, in general, it may range from 1 μm to 5,000 μm, preferably from 3 μm to 1,000 μm, more preferably from 5 μm to 500 μm.

Any processing may also be applied to the substrates to be used. For example, it is possible to apply a desired pattern, appropriate gloss or a silky pattern on the substrates. It is further possible to select as the substrate those having water resistance, abrasion resistance, blocking resistance or the like to impart the water resistance, abrasion resistance, blocking resistance or the like to the image-viewing surface of the recording medium.

The ink-transporting layer constituting the recording medium used in the present invention is required at least to have liquid-permeability. The liquid-permeability mentioned in the present invention refers to a property of rapidly passing an ink and causing substantially no dyeing by the ink in the ink-transporting layer. A preferred embodiment for improving the liquid-permeability of the ink-transporting layer is the one having the porous structure wherein cracks or through-holes are present inside the ink-transporting layer.

In instances in which the images obtained by the recording medium of the present invention are viewed from the opposite side to the ink-applying surface as previously mentioned, the ink-transporting layer may preferably have light diffusibility.

The ink-transporting layer satisfying the above properties may have any constitution so long as it has the above properties, and can be formed by;

(1) a method in which a coating solution comprising particles and a binder is applied on the ink-retaining layer;

(2) a method in which a plastic film or the like having through-holes is laminated on the ink-retaining layer;

(3) a method in which a resin that is soluble to Solvent A but insoluble to Solvent B compatible with Solvent A is dissolved in Solvent A, the resulting solution is applied onto the ink-retaining layer, and thereafter the resulting coating is dipped in Solution B to substitute Solution A, thus forming a layer having through-holes opening in the thickness direction;

(4) a method in which a layer having a fine sea-and-island (or isles-in-sea) structure is formed on the ink-retaining layer by use of two types of materials that are poorly compatible with each other, and thereafter dipped in a solvent capable of dissolving only the island (or isle) parts to form a porous layer; etc.

Of these methods, preferred is the method of the above (1) in which the layer is constituted of a particulate material and a binder.

Considering that the dyes in inks are water-soluble in general, particularly suitable particulate materials in the recording medium used in the present invention include organic particles of highly hydrophobic thermoplastic resins, thermosetting resins or the like, as exemplified by powders of resins such as polystyrene, polymethacrylate, polymethyl methacrylate, elastomers, an ethylene/vinyl acetate copolymer, a styrene/acrylic acid copolymer, polyester, polyacrylate, polyvinyl ether, polyamide, polyolefin, polyimide, guanamine, SBR, NBR, MBS, polytetrafluoroethylene, urea, polyvinyl chloride, polyacrylamide and chloroprene, and at least one of emulsions or suspensions of any of these is used as desired.

For the purpose of increasing the whiteness of the ink-transporting layer, there may be also added white inorganic pigments to the extent that the ink-permeability of the ink-transporting layer may not be hindered, as exemplified by talc, calcium carbonate, calcium sulfate, magnesium hydroxide, basic magnesium carbonate, alumina, synthetic silicia, calcium silicate, diatomaceous earth, aluminum hydroxide, clay, barium sulfate, titanium oxide, zinc oxide, zinc sulfide, satin white, silicon oxide, lithopone, etc.

The binder to be used is a material having the function of binding the above particles to each other and/or the particles and ink-retaining layer. Materials preferred as the binder include any of conventionally known materials as they can be used so long as they have the above functions, and, for example, there can be used as desired, one or more of resins such as polyvinyl alcohol, acrylic resins, a styrene/acrylic acid copolymer, polyvinyl acetate, an ethylene/vinyl acetate copolymer, starch, polyvinyl butyral, gelatin, casein, ionomers, gum arabic, carboxymethyl cellulose, polyvinyl pyrrolidone, polyacrylamide, polyurethane, melamine, epoxy, styrene-butadiene rubber, urea, phenol, α-olefin, chloroprene, and nitrile rubber.

For the purpose of improving the above functions as the ink-transporting layer, various additives as exemplified by fluorescent dyes, coloring dyes, etc. may optionally be further added to the ink-transporting layer.

Mixing ratio (weight ratio) of the above particulate material and a binder may preferably be in the range of particles/binder=from 1/5 to 50/1, more preferably in the range of from $\frac{1}{3}$ to 20/1. In this mixing ratio, an excessively large proportion of the binder may decrease the cracks or through-holes in the ink-transporting layer, resulting in a decrease in ink-absorption effect. In the mixing ratio also, an excessively large proportion for the particles may cause insufficient binding between particles or between the ink-retaining layer and particles, resulting in insufficiency in the strength of the ink-transporting layer and making it impossible to form the ink-transporting layer.

The thickness of the ink-transporting layer depends on the quantity of ink droplets, but may range from 1 to 300 μm, preferably from 2 to 200 μm, and more preferably from 3 to 80 μm.

The ink-retaining layer which is non-porous and capable of substantially capturing inks or dyes to produce colors, is a layer to absorb and capturing the dye into the ink having passed through the ink-transporting layer, and retain them substantially permanently.

The ink-retaining layer is required to have higher absorbing ability than the ink-transporting layer. This is because if the absorbing ability of the ink-retaining layer is lower than the absorbing ability of the ink-transporting layer, the inks applied on the surface of the ink-transporting layer may stagnate in the ink-transporting layer when they pass through the ink-transporting layer and the lead of inks has reached to the ink-retaining layer, and consequently the ink penetrates and diffuses excessively at the interface between the ink-transporting layer and ink-retaining layer in the lateral direction inside the ink-transporting layer thereof. As a result, the resolution of recorded images is lowered, making it impossible to form recorded images of high quality.

In instances in which the recorded images are viewed from the opposite side to the recording surface as previously mentioned, the ink-retaining layer may preferably be light-transmissive.

The thickness of the ink-retaining layer may be satisfactory if it is enough to absorb and capture the ink, and vary depending on the quantity of ink droplets. It, however, may range from 1 to 70 μm, preferably to 50 μm, and more preferably from 3 to 20 μm.

The materials constituting the ink-retaining layer may be any materials so long as they can absorb water-based inks and retain a dye contained in an ink, but may preferably be prepared from a water-soluble or hydrophilic polymer considering that inks are mainly aqueous inks. Such water-soluble or hydrophilic polymers may include, for example, natural resins such as albumin, gelatin, casein, starch, cationic starch, gum arabic and sodium alginate; synthetic resins such as carboxymethyl cellulose, hydroxyethyl cellulose, polyamide, polyacrylamide, polyethyleneimine, polyvinylpyrrolidone, quaternized polyvinylpyrrolidone, polyvinylpyridinium halide, a melamine resin, a phenol resin, an alkyd resin, polyurethane, polyvinyl alcohol, ionically modified polyvinyl alcohol, polyester and sodium polyacrylate; preferably, hydrophilic polymers mad water-insoluble by cross-linking or any of these polymers, hydrophilic and water-insoluble polymer complexes comprising two or more polymers, and hydrophilic and water-insoluble polymers having hydrophilic segments; etc. For the purpose of improving the above functions as the ink-retaining layer, various additives as exemplified by a surfactant, a water-resisting agent, an organic or an inorganic pigment, etc. may optionally be further added to the ink-retaining layer.

Methods of forming the ink-retaining layer and the ink-transporting layer on the substrate may preferably include a method in which any of the materials set out in the above as preferred examples are dissolved or dispersed in a suitable solvent to prepare a coating solution, and the resulting coating solution is applied on the substrate by a known coating process such as roll coating, rod bar coating, spray coating or a air knife coating, followed immediately by drying, or alternatively a method in which any of the above materials are applied on the substrate by hot melt coating, or a sheet is separately formed from any of the above materials in advance and the resulting sheet is laminated on the substrate.

When the ink-retaining layer is provided on the substrate, it is preferred to strengthen the adhesion between the substrate and the ink-retaining layer by forming, for example, an anchor coat layer, to give no gap therebetween.

Presence of the gap between the substrate and ink-retaining layer may cause irregular reflection on the recorded-image-viewing surface to substantially lower the image optical density, undesirably.

The present invention is chiefly characterized in that, in the constitution of the recording medium as described above, a surfactant and/or a penetrant and a material capable of fixing colorants in inks (hereinafter "colorant-fixing material") are contained in combination in the ink-transporting layer, provided that the colorant-fixing material may preferably be contained in both of the ink-transporting and ink-retaining layer.

Embodiments of the above colorant-fixing material can be classified into the following three groups:

The particles and the binder constituting the ink-transporting layer are treated as below:

1. a compound having the property of fixing a colorant is applied to the surface of the particles;

2. a compound having the property of fixing a colorant is applied to the surface of the binder; and, in addition to those applied to the particles and binder;

3. a colorant-fixing material to be added as an additional component is used.

To illustrate below preferred examples of the above three embodiments, respectively;

1. a cationic compound as exemplified by polyamidoepichlorohydrin, trimethyl-3-(propylepichlorohydrin-)ammonium chloride, etc. is reacted on functional groups possessed by the particles on their surfaces; alternatively, a cationic monomer as exemplified by dimethyl aminoethyl acrylate or methacrylate, diethyl aminoethyl acrylate or methacrylate, trimethyl-3-(1-acryl- or methacrylamido-1,1-dimethylpropyl)ammonium chloride, trimethyl-3-(1-acryl- or methacrylamido-1,1-dimethylethyl) ammonium chloride, etc. is copolymerized at the time of the synthesis of the particles;

2. the binder is cationally modified with, for example, polyamidoepichlorohydrin, trimethyl-3-(propylepichlorohydrin)ammonium chloride, etc.; alternatively, a cationic monomer as exemplified by dimethylaminoethyl acrylate or methacrylate, diethylaminoethyl acrylate or methacrylate, trimethyl-3-(1-(meth)acryamido-1,1-dimethylpropyl)ammonium chloride, trimethyl-3-(1-(meth)acrylamido-1,1-dimethylethyl) ammonium chloride, etc. is copolymerized at the time of the synthesis of the binders; and 3. preferably used is a compound having a primary to tertiary amino group or a quaternary ammonium group, as exemplified by nonvolatile amines or various polymers having any of these groups, including, for example, polyallylamine, polyvinylpyrrolidone, polyvinylpyridine, quaternized polyvinylpyridine, polyethyleneimine, cationized polyvinyl alcohol, cationized starch, polyamidoepichlorohydrin, cationic surfactants, etc. Also advantageously usable are salts of alkaline earth metals such as calcium, barium and strontium, and other polyvalent metals such as aluminum, zinc and manganese.

The above colorant-fixing material can be suitably used when the colorant in the ink is an acidic dye or a direct dye having a sulfonic group, a carboxylic or a phenolic hydroxyl group.

Alternatively, in instances where the basic dyes having a primary, secondary, or tertiary amino group or a quaternary ammonium group are used, advantageously usable are materials that may act on these dyes to make then insoluble, as exemplified by nonvolatile compounds or polymers having a sulfonic group, a carboxyl group, a sulfuric acid ester group, a phenolic hydroxyl group or the like, or it is also possible to use the above functional groups by applying them on the surface of the particles or binder. Also advantageously usable are solid acidic materials such as activated clay, acidic clay and Lewis acids.

The method for incorporating the colorant-fixing materials as described above into the above recording medium of the present invention is carried out by adding the colorant-fixing material as described above to coating solutions used when the ink-transporting layer and the ink-retaining layer are respectively formed, to form respectively the ink-transporting layer and the ink-retaining layer.

When these colorant-fixing materials are added in the ink-transporting layer, these colorant-fixing materials should be used preferably in an amount of 0.05% by weight or more, more preferably 0.1% by weight or more, of the weight of the ink-transporting layer. The amount for the addition otherwise less than 0.05% by weight may result in insufficient effect of fixing the colorants, and cause the problem that the feathering of recorded images occurs after storage for a long period of time or storage under the condition of high humidity.

There is no particular limitation when these materials are added in the ink-retaining layer, but in general they are used in an amount of approximately from 0.5 to 50% by weight of the weight of the ink-retaining layer.

On the other hand, in the recording medium of the present invention, it is essential for that ink-transporting layer to contain in combination the above colorant-fixing material and a surfactant and/or a penetrant, and the mixing ratio (weight ratio) of the colorant-fixing material to the surfactant and/or the penetrant may preferably be in the range of surfactant and/or penetrant/colorant-fixing material=from 1/100 to 0/1, more preferably in the range of from 1/50 to 5/1. In this mixing ratio, an excessively large amount of the colorant-fixing material may bring about the disadvantages that the ink permeability of the ink-transporting layer becomes poorer, the ink absorbing ability of the recording medium is decreased, and the image density on the viewing surface is lowered. On the other hand, in the mixing ratio, an excessively large amount of the surfactant and/or the penetrant may bring about the disadvantages that the colorants in inks, more or less remaining in the ink-transporting layer, migrate in a diffusing state during storage of the resulting records for a long period of time or storage under the condition of high humidity to cause the feathering of images. There is no particular limitation in selecting the surfactant and the penetrant, and all of those conventionally known can be used.

The surfactant used in the present invention are any of nonionic surfactants, cationic surfactants, nonionic surfactants and amphoteric surfactants. For example, the nonionic surfactants are alkyl sulfates such as sodium lauryl sulfate, monoethanolamine lauryl sulfate, triethanolamine lauryl sulfate and sodium cetylsulfate; polyoxyethylene alkyl ether sulfates such as sodium polyoxyethylene lauryl ether sulfate, triethanolamine polyoxyethylene lauryl ether sulfate and sodium polyoxyethylene nonyl ether sulfate; alkyl phosphates such as sodium lauryl phosphate and sodium oleyl phosphate; polyoxyethylene alkyl ether phosphates such as sodium polyoxyethylene lauryl ether phosphate, tripolyoxyethylene alkyl ether phosphates and dipolyoxyethylene alkyl ether phosphates; alkyl benzene sulfonic acids such as dodecyl benzene sulfonic acid; polyoxyethylene alkyl ether acetates, alkylsulfosuccinates, $\alpha$-olefin sulfonates, acyl collagen peptide salts, N-acyl methyltaurine salts, N-acyl aminos and salts thereof, fluorine type surfactants, etc. Used as the cationic surfactants are quarternary ammonium salts such as benzalconium chloride and cetyltrimethyl ammonium bromide. Used as the non-ionic surfactants are polyoxyethylene alkyl ethers such as polyoxyethylene lauryl ether, polyoxyethylene cetyl ether, polyoxyethylene oleyl ether; polyoxyethylene alkyl phenyl ethers such as polyoxyethylene nonyl phenyl ether and polyoxyethylene octyl phenyl ether; sorbitan fatty acid esters such as sorbitan monooleate, sorbitan monopalmitate and sorbitan tristerate; glycerol fatty acid esters such as glyceryl monosterate and glyceryl dioleate; polyoxyethylene alkylamines such as polyoxystearylamine, polyoxyethylene oleylamine; polyoxyethylene fatty acid amides, polyoxyethylene lanolin derivatives, polyoxyethylene fatty acid esters, polyglycerol fatty acid esters, propylene glycol fatty acid esters, pentaerythritol fatty acid esters, polyoxyethylene soribtan fatty acid esters, polyoxyethylene sorbit fatty acid esters, fluorine type nonionic surfactants, etc.

The penetrant refers to an agent used to promote the ability for inks to permeate into the recording medium, and includes, for example, glycol ethers such as ethylene glycol monomethyl ether, ethylene glycol monoethyl ether, ethylene glycol monophenyl ether, diethylene glycol monomethyl ether, diethylene glycol monoethyl ether and diethylene glycol monobutyl ether, of which particularly used are ethylene glycol monophenyl ether, diethylene glycol monobutyl ether, etc.

According to the present invention as described above, because of the presence of the material capable of fixing colorants in inks in the ink-transporting layer of the recording medium, the colorants remaining in a small amount in the ink-transporting layer is kept stationary (or being fixed) by the colorant-fixing material in the ink-transporting layer even if the ink-transporting layer has absorbed water to some extent when the records are stored after the recording. Moreover, the ink permeability of the ink-transporting layer may not be reduced by the presence of the colorant-fixing material, and therefore the ink absorbing ability is kept superior and the image density on the viewing surface is kept high.

Since the recording medium of the present invention is not of the type the images are viewed from the ink-transporting layer which is a porous layer but of the type the images are viewed from the substrate having a smooth surface or the ink-retaining layer side, there can be obtained images with excellent gloss.

EXAMPLES

The present invention will be described below in further greater detail based on Examples and Comparative Examples, In the following, "%" or "part(s)" are by weight unless particularly mentioned. The weights of compounds are all expressed in terms of solids. The ratio of surfactant and/or penetrant to the colorant-fixing material is represented by R.

EXAMPLE 1

Using polyester film (100 μm thick; available from Toray Industries, Inc.) as a light-transmissive substrate, Composition A shown below was applied on this substrate as an ink-retaining layer by means of a bar coater to have a dried thickness of 5 μm, followed by drying in a drying oven for 5 minutes at 140° C.

Composition A:

Hydroxypropyl methyl cellulose (Metholose 90SH15; available from Shin-Etsui Chemical Co., Ltd.) 10 parts Polyamine sulfone (PAS A-5; available from Nitto

| Composition A: | |
|---|---|
| Hydroxypropyl methyl cellulose (Metholose 90SH15; available from Shin-Etsu Chemical Co., Ltd.) | 10 parts |
| Polyamine sulfone (PAS A-5; available from Nitto Boseki Co., Ltd.) | 1 part |
| Water | 20 parts |

Composition B shown below as further applied thereon by means of a bar coater to have a dried thickness of 40 μm, followed by drying for 3 minutes at 140° C. to obtain a recording medium of the present invention.

| Composition B: | |
|---|---|
| Polymethacrylate resin powder (Microsphere M-100, available from Matsumoto Yushi Co., Ltd) | 100 parts |
| Ionomer resin (Chemipearl SA-100; available from Mitsui Petrochemical Industries Co., Ltd.) | 12 parts |
| Fluorine type surfactant (Surflon S-141; available from Asahi Glass Co., Ltd.) | 1 part |
| Polyamine sulfone (PAS A-5; available from Nitto Boseki Co., Ltd.) | 1 part |
| Water | 100 parts |
| (R = 1/1) | |

Using 4 kinds of inks shown in Table 1 below, the recording was performed on the recording medium thus obtained, with use of an ink jet recording apparatus of a bubble jet system. In Table 1, C.I Direct Yellow 86 and C.I. Direct Blue 86 are direct dyes, and C.I. Food Black 2 and C.I. Acid Red 35 are acidic dyes.

With regard to the records thus obtained, the following evaluation was made.

(1) Ink absorbing ability was evaluated by measuring the time elapsing before no ink comes to adhere to fingers when records are touched with fingers after ink jet recording is conducted and the recorded matter is left standing at room temperature.

(2) Image optical density was measured on the image-viewing surface (A) and ink-applying surface (B) in respect of the black ink recorded area by using Macbeth Densitometer RD-918.

(3) Image surface gloss was evaluated by measuring 45° specular gloss of the image-viewing surface according to JIS Z8741.

(4) Regarding the feathering of images, the records obtained by solid printing with red ink were stored for 5 days under the conditions of 35° C. and 85% RH, to measure the spreading of the width of images that became greater relative to that measured before storage. The feathering was also organoleptically evaluated in respect of real images stored under the same conditions, and evaluated according to the three rank system to regard as A those in which no feathering occurred when compared with those observed before storage; B, those in which the feathering slightly occurred; and C, those in which the feathering occurred so seriously that they were not satisfactory for practical use.

TABLE 1

| | |
|---|---|
| Yellow ink (make-up): | |
| C.I.; Direct Yellow 86 | 2 parts |
| Diethylene glycol | 20 parts |
| Polyethylene glycol #200 | 10 parts |
| water | 70 parts |
| Red ink (make-up): | |
| C.I. Acid Red 35 | 2 parts |
| Diethylene glycol | 20 parts |
| Polyethylene glycol #200 | 10 parts |
| water | 70 parts |
| Blue ink (make-up): | |
| C.I. Direct Blue 86 | 2 parts |
| Diethylene glycol | 20 parts |
| Polyethylene glycol #200 | 10 parts |
| water | 70 parts |
| Black ink (make-up): | |
| C.I. Food Black 2 | 2 parts |
| Diethylene glycol | 20 parts |
| polyethylene glycol #200 | 10 parts |
| water | 70 parts |

EXAMPLE 2

Example 1 was repeated to obtain a recording medium of the present invention, except that Compositions C and D shown below were used in place of Compositions A and B in Example 1, and evaluation was made in the same manner as in Example 1.

| Composition C: | |
|---|---|
| Polyvinyl alcohol (PVA 217; available from Kuraray Co., Ltd.) | 10 parts |
| Cationic polyamide (Polyfix 601; available from Showa High Polymer Co., Ltd) | 1 part |
| Water | 90 parts |
| Composition D: | |
| Polymethacrylate resin powder (Microsphere M-100, available from Matsumoto Yushi Co., Ltd) | 100 parts |
| Ionomer resin (Chemipearl SA-100: available from Mitsui Petrochemical Engineering Co., Ltd.) | 12 parts |
| Fluorine type surfactant (Surflon S-141; available from Asahi Glass Co., Ltd.) | 2 part |
| Cationic fluorine type surfactant (Surflon S-121; available from Asahi Glass Co., Ltd.) | 1 part |
| Water | 1,000 parts |
| (R = 2/1) | |

EXAMPLE 3

On a light-transmissive substrate similar to that in Example 1, Composition E shown below was applied as an ink-retaining layer by means of a bar coater to have a dried thickness of 5 μm, followed by drying in a drying oven for 5 minutes at 140° C.

| Composition E: | |
|---|---|
| Polyvinyl alcohol (PVA 420H; available from Kuraray Co., Ltd.) | 100 parts |
| Polyamidoepichlorohydrin (Kymene 557H; available from DIC Hercules Inc.) | 10 parts |
| Water | 900 parts |

On the film thus obtained, Composition F shown below was applied by means of a bar coater to give a dried thickness of 40 μm, followed by drying in a drying oven for 10 minutes at 80° C. to obtain a recording medium of the present invention.

| Composition F: | |
|---|---|
| Low density polyethylene resin (Chemipearl M-200; available from Mitsui Petrochemical Industries, Ltd.) | 100 parts |
| Ethylene/vinyl acetate copolymer resin (Chemipearl V-100; available from Mitsui Petrochemical Industries, Ltd.) | 7 parts |
| Polyamidoepichlorohydrin (Kymene 557H; available from DIC Hercules Inc.) | 5 parts |
| Polyoxyethylene octyl phenyl ether (Emulgen 810; available from Kao Corporation | 0.4 parts |
| Water | 300 parts |
| (R = 1/12.5) | |

On the recording medium thus obtained, evaluation was made in the same manner as in Example 1.

EXAMPLE 4

On a light-transmissive substrate similar to that in Example 1, Composition G shown below was applied as an ink-retaining layer by means of a bar coater to have a dried thickness of 5 μm, followed by drying in a drying oven for 5 minutes at 140° C.

| Composition G: | |
|---|---|
| Polyvinylpyrrolidone (PVP K-90; available from GAF) | 8 parts |
| Novolac type phenol resin (Resitop PSK-2320; available from Gun-ei Chemical Industry Co., Ltd.) | 1 part |
| Polyallylamine hydrochloride (PAA-HC1-3S, available from Nitto Boseki Co., Ltd.) | 1 part |
| Dimethlformamide | 90 parts |

Composition H shown below was further applied thereon by means of a bar coater to give a dried thickness of 40 μm, followed by drying for 3 minutes at 140° C. to obtain a recording medium of the present invention.

| Composition H: | |
|---|---|
| Polymethacrylate resin powder (Microshpere M-100, available from Matsumoto Yushi Co., Ltd) | 100 parts |
| Ionomer resin (Chemipearl SA-100; available from Mitsui Petrochemical Industries Co., Ltd.) | 12 parts |
| Polyallylamine hydrochloride (PAA-HC1-3S, available from Nitto Boseki Co., Ltd.) | 5 parts |
| Sodium dioctyl sulfosuccinate (Pelex OT-P; available from Kao Corporation) | 0.5 part |
| Water | 1,000 parts |
| (R = 1/10) | |

On the recording medium thus obtained, evaluation was made in the same manner as in Example 1.

EXAMPLE 5

On a light-transmissive substrate similar to that in Example 1, Composition I shown below was applied as an ink-retaining layer by means of a bar coater to have a dried thickness of 10 μm, followed by drying in a drying oven for 10 minutes at 140° C.

| Composition I: | |
|---|---|
| Cationized polyvinyl alcohol (C Polymer 318-AA; available from Kuraray Co., Ltd.) | 100 parts |
| Blocked isocyanate compound (Elastron BN-5; available from Daiichi Kogyo Seiyaku Co., Ltd.) | 20 parts |
| Reaction catalyst (Elastron Catalyst 32; available from Daiichi Kogyo Seiyaku Co., Ltd.) | 1 part |
| Sodium carbonate | 1 part |
| Water | 900 parts |

On the film thus obtained, Composition J shown below was applied by means of a bar coater to have a dried thickness of 40 μm, followed by drying in a drying oven for 3 minutes at 140° C. to obtain a recording medium of the present invention.

| Composition J: | |
|---|---|
| Polymethacrylate resin powder (Microsphere M-100, available from Matsumoto Yushi Co., Ltd) | 100 parts |
| Cationized polyvinyl alcohol (C polymer 318-AA; available from Kuraray Co., Ltd.) | 20 parts |
| Blocked isocyanate compound (Elastron BN-5; available from Daiichi Kogyo Seiyaku Co., Ltd.) | 20 parts |
| Reaction catalyst (Elastron Catalyst 32; available from Daiichi Kogyo Seiyaku Co., Ltd.) | 1 part |
| Sodium carbonate | 1 part |
| Fluorine type surfactant (Surflon S-141; available from Asahi Glass Co., Ltd ) | 3 part |
| Water | 1,000 parts |
| (R = 1/33) | |

On the recording medium thus obtained, evaluation was made in the same manner as in Example 1.

EXAMPLE 6

On a light-transmissive substrate similar to that in Example 1, Composition A was applied as an ink-retaining layer by means of a bar coater to have a dried thickness of 5 μm, followed by drying in a drying oven for 5 minutes at 140° C.

On the film thus obtained, Composition K shown below was applied by means of a bar coater to have a dried thickness of 40 μm, followed by drying in a drying oven for 3 minutes at 140° C. to obtain a recording medium of the present invention.

| Composition K: | |
|---|---|
| Cationized polymethacrylate resin powder (Methyl methacrylate:trimethyl-3-(1-acryl- or (meth) acrylamido-1,1-dimethylpropyl)ammonium chloride = 95:5; average particle diameter: 10 μm) | 100 parts |
| Ionomer resin (Chemipearl SA-100; available from Mitsui petrochemical Industries, Ltd.) | 12 parts |
| Fluorine type surfactant (Surflon S-141; available from Asahi Glass Co., Ltd.) | 3 parts |
| Water | 1,000 parts |
| (R = 1/33) | |

On the recording medium thus obtained, evaluation was made in the same manner as in Example 1.

Comparative Example 1

Example 1 was repeated to prepare a recording medium, except that polyamidoepichlorohydrin was removed from Composition B.

Comparative Example 2

Example 1 was repeated to prepare a recording medium, except that polyamidoepichlorohydrin was removed from Composition A and B.

Comparative Example 3

Example 2 was repeated to prepare a recording medium, except that polyallylamine hydrochloride was removed from Composition C and D.

Comparative Example 4

Example 3 was repeated to prepare a recording medium, except that the mixing ratio (R) of polyoxyethylene octyl phenyl ether to polyamidoepichlorohydrin in Composition F was made to R=1/110.

Comparative Example 5

Example 4 was repeated to prepare a recording medium, except that the mixing ratio (R) of polyallylamine hydrochloride to sodium dioctyl sulfosuccinate in Composition H was made to R=15/1.

Comparative Example 6

Example 1 was repeated to prepare a recording medium, except that polyamidoepichlorohydrin in Composition F was added in an amount of 0.02% by weight.

Results of the evaluation in the above Examples and Comparative Examples are shown in Table 2.

TABLE 2

| Examples | 1 | 2 | 3 |
|---|---|---|---|
| Ink absorbing ability: | 1 sec | 1 sec | 1 sec |
| Image optical density: | | | |
| (A) | 1.48 | 1.63 | 1.60 |
| (B) | 0.60 | 0.51 | 0.53 |
| Gloss (%): | 120 | 117 | 116 |
| Feathering: (Spreading) | 0.5 mm | 0.4 mm | 0.4 mm |

TABLE 2-continued

| (Real image) | A | A | A |
|---|---|---|---|
| Examples | 4 | 5 | 6 |
| Ink absorbing ability: | 1 sec | 1 sec | 1 sec |
| Image optical density: | | | |
| (A) | 1.52 | 1.45 | 1.46 |
| (B) | 0.55 | 0.65 | 0.63 |
| Gloss (%): | 120 | 119 | 118 |
| Feathering: (Spreading) | 0.5 mm | 0.4 mm | 0.5 mm |
| (Real image) | A | A | A |
| Comparative Examples | 1 | 2 | 3 |
| Ink absorbing ability: | 1 sec | 1 sec | 1 sec |
| Image optical density: | | | |
| (A) | 1.75 | 1.50 | 1.48 |
| (B) | 0.50 | 0.61 | 0.60 |
| Gloss (%): | 117 | 117 | 121 |
| Feathering: (Spreading) | 1.3 mm | 1.8 mm | 1.6 mm |
| (Real image) | C to B | C | C |
| Comparative Examples | 4 | 5 | 6 |
| Ink absorbing ability: | 2 sec | 1 sec | 1 sec |
| Image optical density: | | | |
| (A) | 1.22 | 1.77 | 1.73 |
| (B) | 1.01 | 0.49 | 0.49 |
| Gloss (%): | 115 | 120 | 117 |
| Feathering: (Spreading) | 0.3 mm | 1.4 mm | 1.3 mm |
| (Real image) | A | C to B | C to B |

What is claimed is:

1. A recording medium comprising a non-porous ink-retaining layer and a porous ink-transporting layer laminated on a substrate in this order, said ink-transporting layer comprising (i) at least one of a surfactant and a penetrant, and (ii) a material which is capable of fixing a colorant contained in an ink, which colorant remains in said ink-transporting layer after application of said ink to said recording medium.

2. The recording medium of claim 1, wherein said ink-transporting layer contains in combination at least one of the surfactant and the penetrant, and the material having the property of fixing the colorant contained in the ink, in the proportion of from 1:100 to 50:1.

3. The recording medium of claim 1, wherein said ink-transporting layer contains in combination at least one of the surfactant and the penetrant, and the material having the property of fixing the colorant contained in the ink, in the proportion of from 1:50 to 5:1.

4. The recording medium of claim 1, wherein said ink-transporting layer contains the material having the property of fixing the colorant contained in the ink, in an amount of from 0.05% by weight or more.

5. The recording medium of claim 1, wherein said ink-transporting layer containing the material having the property of fixing the colorant contained in the ink, in an amount of 0.1% by weight or more.

6. The recording medium of claim 1, wherein said material having the property of fixing the colorant contained in the ink is a nonvolatile compound having a primary, secondary or tertiary amino group, or a quaternary ammonium group.

7. The recording medium of claim 1, wherein said material having the property of fixing the colorant contained in the ink is a salt of a polyvalent metal.

8. The recording medium according to claim 1, wherein said substrate is light-transmissive.

9. The recording medium of claim 1, wherein said ink-transporting layer is light-diffusive.

10. The recording medium of claim 1, wherein said ink-retaining layer is light-transmissive.

11. The recording medium of claim 1, wherein said ink-transporting layer is liquid permeable.

12. The recording medium of claim 1, wherein said ink-retaining layer has a higher absorbability than said ink-transporting layer.

13. A recording medium comprising a non-porous ink-retaining layer and a porous ink-transporting layer laminated on a substrate in this order, said ink-transporting layer comprising (i) at least one of a surfactant and a penetrant, and (ii) a material which is capable of fixing a colorant contained in an ink, which colorant remains in said ink-transporting layer and said ink-retaining layer containing said material or another material capable of fixing the colorant contained in the ink.

14. The recording medium of claim 13, wherein said ink-transporting layer contains in combination at least one of the surfactant and the penetrant, and the material having the property of fixing the colorant contained in the ink, in the proportion of from 1:100 to 50:1.

15. The recording medium of claim 13, wherein said ink-transporting layer contains in combination at least one of the surfactant and the penetrant, and the material having the property of fixing the colorant contained in the ink, in the proportion of from 1:50 to 5:1.

16. The recording medium of claim 13, wherein said ink-transporting layer contains the material having the property of fixing the colorant contained in the ink, in an amount of from 0.05% by weight or more.

17. The recording medium of claim 13, wherein said ink-retaining layer contains the material having the property of fixing the colorant contained in the ink, in an amount of from 0.5 to 50% by weight.

18. The recording medium of claim 13, wherein said material having the property of fixing the colorant contained in the ink is a nonvolatile compound having a primary, secondary or tertiary amino group or a quaternary ammonium group.

19. The recording medium of claim 13, wherein said material having the property of fixing the colorant contained in the ink is a salt of a polyvalent metal.

20. The recording medium of claim 13, wherein said substrate is light-transmissive.

21. The recording medium of claim 13, wherein said ink-transporting layer is light-diffusive.

22. The recording medium of claim 13, wherein said ink-retaining layers is light-transmissive.

23. The recording medium of claim 13, wherein said ink-transporting layer is liquid permeable.

24. The recording medium of claim 13, wherein said ink-retaining layer has a higher absorbability than said ink-transporting layer.

25. A recording medium comprising a non-porous ink-retaining layer and a porous ink-transporting layer laminated on a substrate in this order, said ink-transporting layer substantially comprising (i) a particulate material, (ii) a binder and (iii) at least one of a surfactant and a penetrant, and wherein said particulate material or said binder is capable of fixing a colorant contained in an ink, which colorant remains in said ink-transporting layer.

26. The recording medium of claim 25, wherein said ink-transporting layer contains in combination at least one of the surfactant and the penetrant, and the material having the property of fixing the colorant contained in the ink, in the proportion of from 1:100 to 50:1.

27. The recording medium of claim 25, wherein said ink-transporting layer contains in combination at least one of the surfactant and the penetrant, and the material having the property of fixing the colorant contained in the ink, in the proportion of from 1:50 to 5:1.

28. The recording medium of claim 25, wherein said material having the property of fixing the colorant contained in the ink comprises the particulate material or binder having been subjected to a cationization treatment.

29. The recording medium of claim 25, wherein said ink-retaining layer contains the material having the property of fixing the colorant contained in the ink.

30. The recording medium of claim 25, wherein said substrate is light-transmissive.

31. The recording medium of claim 25, wherein said ink-transporting layer is light-diffusive.

32. The recording medium of claim 25, wherein said ink-retaining layer is light-transmissive.

33. The recording medium of claim 25, wherein said ink-transporting layer is liquid permeable.

34. The recording medium of claim 25, wherein said ink-retaining layer has a higher absorbability than said ink-transporting layer.

* * * * *

UNITED STATES PATENT AND TRADEMARK OFFICE

CERTIFICATE OF CORRECTION

PATENT NO. : 4,954,395

DATED : September 4, 1990

INVENTOR(S) : Kenji Hasegawa, et al.

It is certified that error appears in the above-identified patent and that said Letters Patent is hereby corrected as shown below:

COLUMN 1:

Line 22, "absorb" should read --absorbs--.

COLUMN 2:

Line 1, "Further" should read --Further,--.

COLUMN 3:

Line 17, "remain" should read --remains--.

Line 39, "above the" should read --above and--.

COLUMN 5:

Line 45, "capturing" should read --capture--.

COLUMN 6:

Line 1, "preferably to 50 μm," should read --preferably 2 to 50 μm,--.

Line 18, "mad" should read --made--.

Line 35, "a" should be deleted

UNITED STATES PATENT AND TRADEMARK OFFICE

CERTIFICATE OF CORRECTION

PATENT NO. : 4,954,395

DATED : September 4, 1990

INVENTOR(S) : Kenji Hasegawa, et al.

It is certified that error appears in the above-identified patent and that said Letters Patent is hereby corrected as shown below:

COLUMN 8:

Line 16, "1/100 to 0/1," should read --1/100 to 10/1,--.

COLUMN 9:

Line 1, "soribtan" should read --sorbitan--.

Line 2, "sorbit" should read --sorbitan--.

Lines 52 through 56 should be deleted as duplicative of lines 59-64.

Line 66, "as" should read "was"--.

COLUMN 11:

Line 19, "2 part" should read --2 parts--.

COLUMN 12:

Line 17, "Microshpere" should read --Microsphere--.

Line 62, "3 part" should read --3 parts--.

UNITED STATES PATENT AND TRADEMARK OFFICE

CERTIFICATE OF CORRECTION

PATENT NO. : 4,954,395 Page 3 of 3

DATED : September 4, 1990

INVENTOR(S) : Kenji Hasegawa, et al.

It is certified that error appears in the above-identified patent and that said Letters Patent is hereby corrected as shown below:

COLUMN 13:

Line 59, "evaluation" should read --evaluations--.

COLUMN 15:

Line 12, "layer and" should read --layer after application of said ink to said recording medium and--.

COLUMN 16:

Line 2, "ink-retaining layers" should read --ink retaining layer--.

Line 16, "layer." should read --layer after application of said ink to said recording medium.--.

Signed and Sealed this

Sixteenth Day of June, 1998

Attest:

Bruce Lehman

BRUCE LEHMAN

Attesting Officer

Commissioner of Patents and Trademarks